US005090048A

United States Patent [19]

Blake

[11] Patent Number: 5,090,048

[45] Date of Patent: Feb. 18, 1992

[54] SHIELDED ENCLOSURE WITH AN ISOLATION TRANSFORMER

[75] Inventor: James A. Blake, Franklin, Wis.

[73] Assignee: General Electric Company, Milwaukee, Wis.

[21] Appl. No.: 703,948

[22] Filed: May 22, 1991

[51] Int. Cl.[5] ..... H05G 1/04

[52] U.S. Cl. ..... 378/202; 378/91; 378/101

[58] Field of Search ..... 378/91, 199, 200, 201, 378/202, 101

*Primary Examiner*—Craig E. Church

*Attorney, Agent, or Firm*—Quarles & Brady

[57] ABSTRACT

An assembly for an X-ray imaging apparatus has a vacuum tube with an envelope containing an anode, a cathode and a filament. The vacuum tube is enclosed in an electrically conductive casing along with a high voltage supply for the tube. Electrical current is supplied to components within the casing by one or more transformers that extend through openings in the casing. Each transformer has an annular core that is sealed to the casing by magnetically non-conductive material. Another magnetically non-conductive seal extends across the central opening in the core. Thus each transformer is mounted in a manner that hermetically seals the aperture through which it extends. Each transformer has a one winding magnetically coupled to the core outside the casing, and another winding magnetically coupled to the core inside the casing and connected to an internal component of the assembly.

14 Claims, 2 Drawing Sheets

SHIELDED ENCLOSURE WITH AN ISOLATION TRANSFORMER

BACKGROUND OF THE INVENTION

The present invention relates to enclosures which shield their exterior environments from electro-magnetic radiation that is generated within the enclosures, and more specifically to shielded enclosures for use in X-ray imaging apparatus which house an X-ray tube.

The X-ray imaging apparatus includes a vacuum tube, having a cathode and an anode, which emits X-rays when properly biased. The cathode comprises a tungsten thermionic emitting source and focusing surfaces. The cathode assembly of an X-ray tube typically also includes a filament that heats the cathode to an temperature at which it emits electrons. Upon the application of a bias voltage potential across the anode and cathode, the thermionically emitted electrons traverse the vacuum gap between the cathode and the anode, impacting the anode and thereby generating X-radiation. X-ray tubes used for medical diagnostic imaging are operated at very high anode-cathode voltages, typically 40,000 to 150,000 volts.

This range of operating voltages produces intense electric fields in the vacuum between the anode and the cathode. Such fields are intensified by sharp edges and particles on the surface of the electrodes. If the electric field intensity becomes high enough, a high voltage instability, or discharge, occurs which partially vaporizes the irregularity that produced the high field intensity. If the new surface following the vaporization is not smooth enough to sufficiently lower the electric field intensity, the process randomly repeats until the surface will support the high voltage for an extended period of time. A newly manufactured tube must be "seasoned" by intentionally producing the discharges under controlled conditions. These discharges, also called "tube spits", occur occasionally throughout the life of an X-ray tube providing a means by which the tube cleans itself.

Unfortunately, the high voltage discharges excite the natural resonances of the electrical circuits inside the tube casing. The resulting high frequency oscillations, typically in the range of 100 megahertz, are conducted by cables into the high voltage power supply for the tube an by other electrical connections. From these connections the high frequency signals radiate into electronic equipment in the vicinity of the X-ray apparatus. These oscillations often have very high power which commonly cause the electronic equipment to malfunction and may permanently damage sensitive electronic components.

SUMMARY OF THE INVENTION

A casing encloses electrical equipment and provides a shield against electromagnetic radiation entering or exiting the enclosure formed by the casing. For example, an X-ray imaging system has a vacuum tube enclosed in a grounded electrically conductive casing formed of a lead alloy to prevent X-rays and radio frequency signals produced within the casing from radiating into the environment. Preferably, the casing also houses a source of a high voltage to excite the vacuum tube to generate X-rays.

Electrical power is supplied to the electrical equipment by a transformer that extends through the casing. The transformer has a magnetically conductive annular core sealed within an aperture in the casing. A first winding is magnetically coupled to the core outside of the casing and a second winding is magnetically coupled to the core inside the casing. The second winding is connected to supply power to the enclosed equipment. The transformer is designed to pass alternating power to the source while blocking high frequency signals.

For an X-ray imaging system, one transformer that extends through the casing carries power to the source of a high voltage. Another of these transformers feeds electrical current to a motor that rotates an anode within the vacuum tube. Additional transformers and circuitry are incorporated to carry control signals in and out of the casing.

A general object of the present invention is to provide a shielded enclosure for electrical equipment, which blocks undesirable electromagnetic radiation or conduction from entering or exiting the enclosure.

Another object is to provide a means for coupling electrical signals between the inside and outside of the enclosure without significantly affecting the shielding.

Yet another object is to use transformers to couple the signals and to hermetically seal the transformers through openings in the enclosure.

A more specific object is to provide a shielded enclosure for an X-ray tube to block high frequency signals generated by high voltage discharges in the tube from radiating beyond the enclosure.

DESCRIPTION OF THE PRESENT INVENTION

Figure 1:
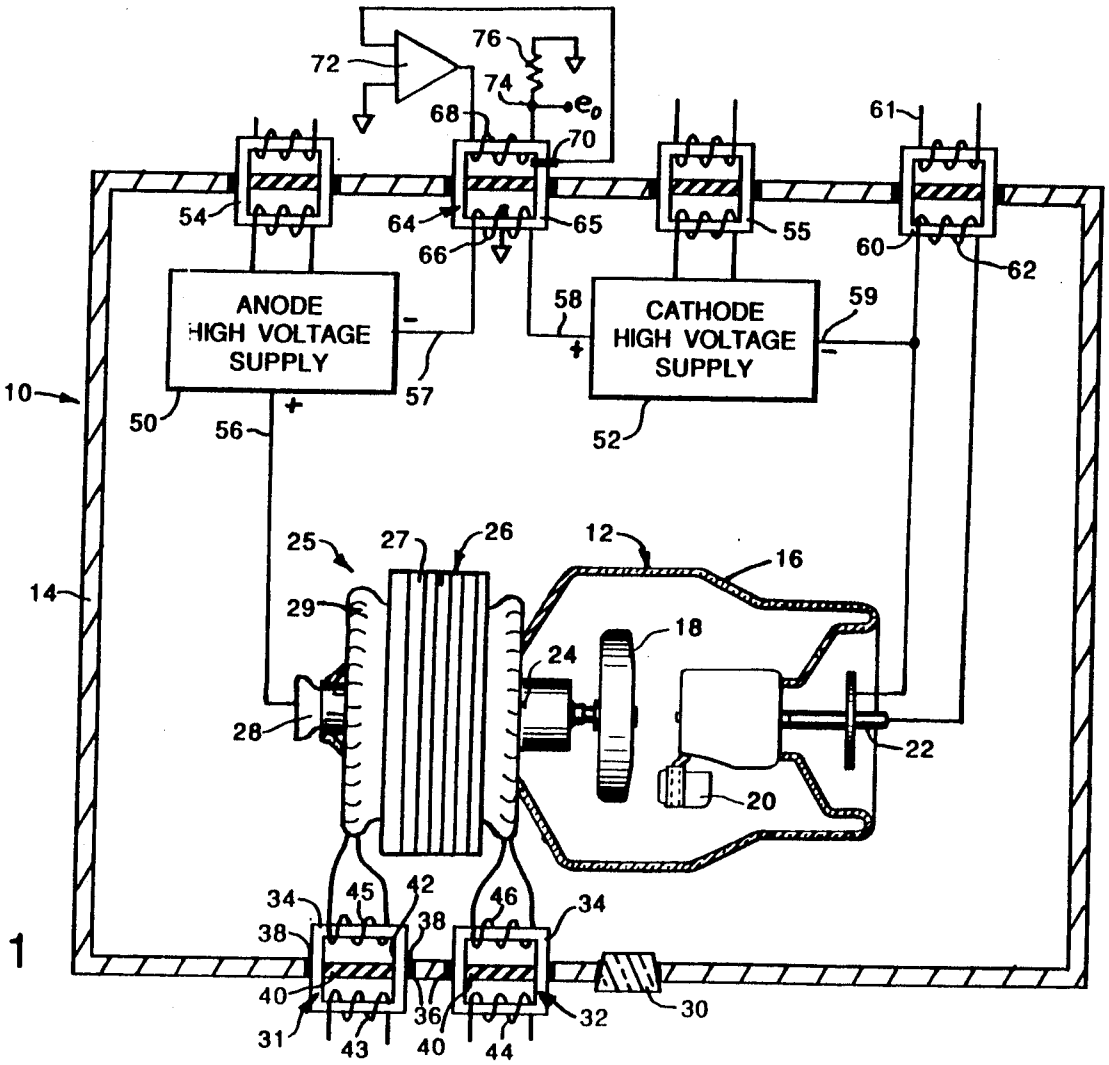
FIG. 1 is a partial cross section view of an enclosure for an X-ray tube according to the present invention.

With initial reference to FIG. 1, an X-ray tube assembly, generally designated as 10, contains a vacuum tube 12 within an enclosure, or casing, 14. The enclosure is filled with electrical insulating, thermally conductive oil. The vacuum tube 12 is of a conventional design with an evacuated glass envelope 16 that encloses an anode 18 and a cathode assembly 20. The cathode assembly 20 consists of a thermionic emissive cathode and a filament which heats the cathode to an operating temperature at which electron emission will occur. The cathode assembly 20 is coupled to a connector 22 to which the filament current and cathode bias potential are applied. Another connector 28 extends through the tube envelope 16, providing a terminal to which the anode potential may be applied.

The shape and size of the enclosure 14 is designed to house the components of the X-ray tube assembly 10 and fit within an outer housing of an X-ray apparatus (not shown). The enclosure 14 is fabricated from an electrically conductive metal alloy containing lead so that when grounded, the external environment will be shielded from both X-rays and radio frequency signals generated within the enclosure. A small "X-ray window" 30 positioned in a wall of the enclosure so that a beam of X-rays generated by the electron bombardment of the anode 18 can travel outward along a desired path.

The anode 18 is of a rotating type and is coupled to rotor 24 of a two-phase motor 25. The rotor 24 is located within a neck of the vacuum tube 12 about which is mounted a stator 26 of motor 25. The vacuum tube 12 and motor 25 are supported within the enclosure by conventional means, which has not been shown for ease of illustration. The stator 26 has a laminated stack 27 through which a pair of coils are wound. In this common design, the rotor 24 is contained within the vacuum tube and the stator 26 is outside the tube envelope 16.

Electrical current for the motor 25 is passed through a wall of the enclosure 14 via a pair of transformers 31 and 32, each of which conducts the current for one phase coil 29 of the stator. These transformers 31 and 32 consist of cores 34 positioned in separate apertures 36 through the enclosure 14. The core 34 of each transformer may either be a solid magnetically conductive material or a conventional laminate design. If the core is a laminate, a fluid-tight seal must be provided between the layers of the laminate, such as by applying an epoxy resin between each layer during assembly. A fluid tight seal 38 extends around the edge of the aperture between the outer surface of the first transformer 31 and the housing 14. An inner seal 40 extends across the inner opening 42 of the transformer core 34, providing a hermetic seal across that gap. The seals 38 and 40 are formed of magnetically non-conductive material, such as an epoxy resin or Fiberglas (Trademark of Owens-Corning Fiberglas Corp.), which will not magnetically short the transformer cores. The other motor current transformer 32 has a similar set of seals. Thus, the transformers 31 and 32 extend through openings in the enclosure 14 in a manner which seals the enclosure, preventing the internal oil from escaping.

The motor currents for each phase of the motor 25 are applied through the different primary windings 43 and 44 and wound around the portion of the respective cores that is outside the enclosure 14. Each motor transformer 31 and 32 has a separate secondary winding 45 and 46, respectively, wound around the portion of the core which is inside the enclosure 14. The secondary windings 45 and 46 of the motor transformers are connected to different stator coils 29.

Also within the enclosure 14 are conventional anode and cathode high voltage supplies 50 and 52, which combined form a bias supply for the X-ray vacuum tube 12. Each of the high voltage supplies 50 and 52 converts a relatively low AC input voltage to a high DC voltage for biasing the electrodes of the vacuum tube 12. The input voltage for the high voltage supplies 50 and 52 is coupled through the wall of the enclosure 14 by transformers 54 and 55 which are similar in design to the motor transformers 31 and 32. The anode high voltage supply 50 has a positive output terminal 56 that is connected to the anode terminal 28 of the vacuum tube 12. The cathode high voltage supply 52 has a negative output terminal 59 which is connected to a contact on the vacuum tube cathode terminal 22 that is connected directly to the cathode in assembly 20.

The negative output terminal 59 is also connected to one end of the secondary winding 62 of a filament current transformer 60. The other end of the secondary winding 62 is connected to another contact of the cathode terminal 22. The filament current for the vacuum tube is applied through the primary winding 61 of transformer 60 to produce a current in the secondary winding 62 that is applied to the filament of the cathode assembly 20. A rectifier (not shown) can be provided inside the enclosure 14 to produce a d.c. filament current, if desired. The filament transformer 60 has a similar configuration to that of the previously described transformers in that it extends through an aperture in the enclosure 14 in a manner which seals the aperture so that the oil within the enclosure cannot leak out.

The high voltage supplies 50 and 52 are connected to a mechanism for monitoring the d.c. anode-cathode current. This mechanism includes a current sensing transformer 64 which extends through another aperture in the enclosure 14. This transformer 64 has a center-tapped first winding 66 within the enclosure. One end of the first winding 66 is connected to the negative terminal 57 of the anode high voltage supply 50 and its other end is connected to the positive terminal 58 of the cathode high voltage supply 52. The center tap of the first winding 66 is connected to the circuit ground of the X-ray imaging system. Unlike the previously described transformers, the current sensing transformer 64 has a gap through its core 65 within which is mounted a conventional magnetic flux sensor 70. The magnetic flux sensor 70 is connected to the inverting input of amplifier 72, the non-inverting input of which is connected to the circuit ground. The output of amplifier 72 is connected to one end of a second winding 68 of the current sensing transformer 64 which is outside the enclosure 14. The other end 74 of the second winding 68 is coupled to ground by a current sensing resistor 76.

The d.c. anode to cathode current flows through the first winding 66 of the current sensing transformer 64 and produces a magnetic flux within the core 65. The magnetic flux has a magnitude that is proportional to the level of the anode to cathode current $I_1$. The flux sensor 70 supplies a signal to amplifier 72 that corresponds to the magnitude of the magnetic flux, and thereby the level of the cathode to anode current $I_1$. The amplifier 72 responds to the flux sensor signal by producing an output current $I_2$ that is applied through the second winding 68 of the current sensing transformer 64. The amplifier 72 responds to the signal from the magnetic flux sensor by varying the magnitude of its output current $I_2$ until a zero net magnetic flux is sensed in the transformer core 65. At that time, the magnitudes of the two currents $I_1$ and $I_2$ are given by the relationship $I_2=I_1\ (T_1/T_2)$, where $T_1$ is the number of turns in the first winding 66 of the current transformer 64 and $T_2$ is the number of turns in the second winding 68. The amplifier current $I_2$ produces a voltage $e_0$ across the sensing resistor 76 that is proportional to the anode to cathode current according to the equation: $e_0=I_2R_{76}=I_1\ (T_1/T_2)\ R_{76}$, where $R_{76}$ is the resistance of the current sensing resistor 76. Thus by measuring the voltage $e_0$, this equation can be solved for the magnitude of the anode to cathode current $I_1$.

Figure 2:
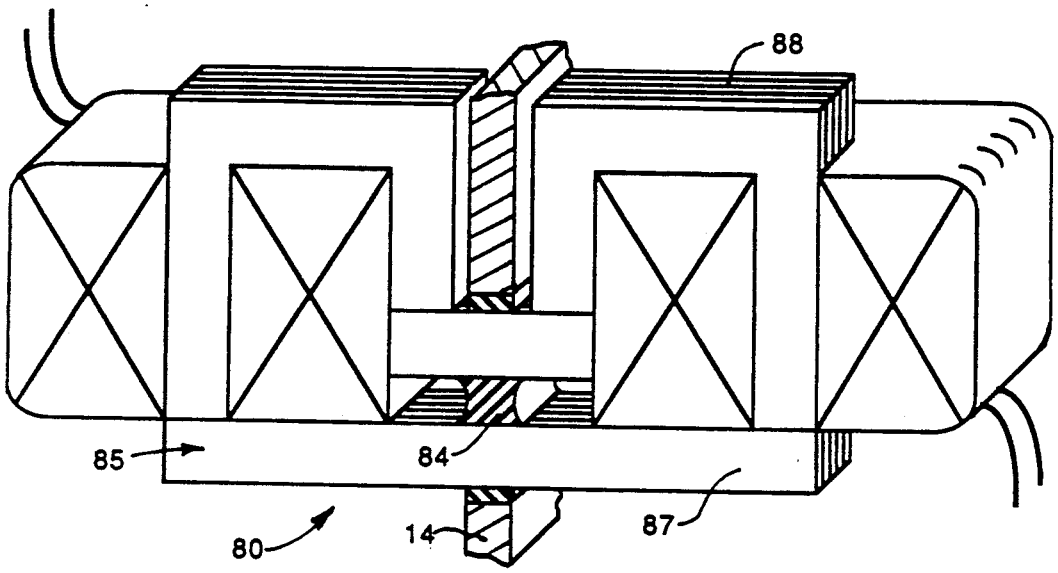
FIGS. 2 and 3 illustrate two alternative embodiments for the transformers shown in FIG. 1.
Figure 3:
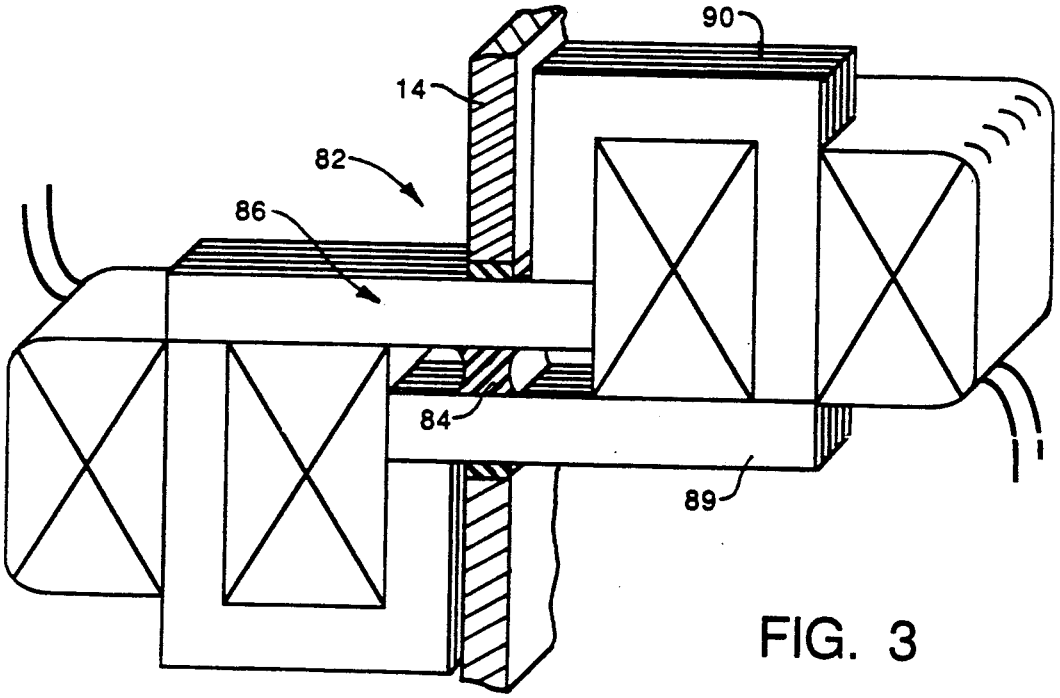

Although the transformers illustrated in FIG. 1 have a rectangular-shaped annular core, other geometrical shapes may be utilized, such as cores 85 and 86 illustrated in FIGS. 2 and 3, respectively. These alternative core designs permit the size of the aperture in the tube enclosure 14 through which the core passes to be reduced. The smaller size of the enclosure aperture reduces the area through which high frequency signals produced by the spits can escape the enclosure 14. Furthermore, these alternative designs have a relatively small gap across the inner opening of the core which is filled by seal 84. The structural integrity of the seal 84 is improved by reducing the size of the gap spanned by the seal. Since the size of the aperture in the enclosure 14 through which the transformer 80 or 82 passes is less than the outer dimension of the transformer, each core 85 or 86 is divided into two segments which connect to form a contiguous magnetic core. In FIG. 2, core 85 is formed by segments 87 and 88, while core 86 in FIG. 3 has segments 89 and 90. Alternatively, the enclosure 14 can be formed by different sections which abut at the location of the transformer and form the aperture.

Each of the transformers has a band-pass which includes the frequency of the current that is to be coupled through the transformer. For example, the transformers pass signals having frequencies less than one megahertz, which is substantially below the frequencies produced by the discharge spits. Thus, the signals induced in the components within the vacuum tube enclosure 14 by the spit discharge will not be conducted by the transformers through the enclosure. As a result, the enclosure provides a shield against the high frequency signals radiating into other components of the X-ray system or into electronic equipment in the vicinity.

Although the present invention have been described in the context of an enclosure for an X-ray tube the basic concept has application generically to enclosures for shielding against electro-magnetic radiation. Furthermore, it is understood that various modifications and changes may be made without departing from the spirit and scope of this invention. For example, although each transformer has been illustrated as passing through a separate aperture in the enclosure 14, two or more transformers may be positioned in the same aperture. In this case, a means would be provided to attach the plurality of transformers to the enclosure in a manner which hermetically seals the common aperture.

I claim:

1. An assembly for an X-ray imaging system comprising:

a vacuum tube for emitting X-radiation and including a cathode, an anode and a filament;

an electrically conductive enclosure around said vacuum tube;

a plurality of transformers, each of which extending through an aperture in said enclosure and attached to the enclosure in a manner that hermetically seals the aperture, and each transformer having a magnetically conductive core, a first winding magnetically coupled to the core outside said enclosure and a second winding magnetically coupled to the core inside said enclosure; and a bias supply within said enclosure connected to apply a voltage across the anode and cathode of said vacuum tube, and coupled to the second winding of a first one of said plurality of transformers;

the second winding of a second one of said plurality of transformers being connected to the filament of said vacuum tube.

2. The assembly as recited in claim 1 wherein said vacuum tube further includes a motor having an rotor connected to the anode, and a stator connected to the second winding of a third one of said plurality of transformers.

3. The assembly as recited in claim 1 wherein said vacuum tube further includes a multi-phase motor having an rotor connected to the anode, and a stator with a plurality of electrical coils with each coil connected to the second winding of a different one of said plurality of transformers.

4. The assembly as recited in claim 1 wherein said bias supply comprises:

an anode supply connected to the second winding of the first one of said plurality of transformers, said anode supply having a positive output terminal connected to the anode of said vacuum tube and having a negative output terminal; and a cathode supply connected to the second winding of a third one of said plurality of transformers, said cathode supply having a negative output terminal connected to the cathode of said vacuum tube and having a positive output terminal coupled to the negative output terminal of said anode supply.

5. The assembly as recited in claim 4 further comprising a current sensing transformer extending through an aperture in said enclosure and attached to the enclosure in a manner that hermetically seals the aperture, and including another magnetically conductive core to which a pair of coils are magnetically coupled with one coil inside said enclosure and the other coil outside said enclosure, the one coil connected between the negative output terminal of said anode supply and the positive output terminal of said cathode supply, and a center tap of the one coil being connected to ground, said current sensing transformer further including a means for sensing magnetic flux in its core.

6. The assembly recited in claim 5 further comprising:

means for producing a current having a magnitude that corresponds to a magnetic flux intensity detected by said means for sensing magnetic flux, and applying that current through the other coil of said current sensing transformer; and means for sensing the magnitude of the current from said means for producing.

7. The assembly recited in claim 1 further comprising an electrically non-conductive fluid within said enclosure and substantially immersing said vacuum tube and said bias supply.

8. An X-ray tube assembly comprising:

a vacuum tube for emitting X-rays and including a cathode, an anode and a filament;

an electrically conductive case enclosing said vacuum tube; and a first transformer extending through an aperture in said case and attached thereto in a manner that hermetically seals the aperture, said first transformer having a magnetically conductive annular first core, a first winding magnetically coupled to the first core outside said case, and a second winding magnetically coupled to the first core inside said case for supplying voltage to said vacuum tube.

9. The X-ray tube assembly as recited in claim 8 further comprising a first seal between the first transformer and said case, and formed of a substantially magnetically non-conductive material.

10. The X-ray tube assembly as recited in claim 9 further comprising a second seal across a central opening of the first core, and formed of a substantially magnetically non-conductive material.

11. The X-ray tube assembly as recited in claim 10 further comprising an electrically non-conductive fluid within said casing substantially immersing said vacuum tube.

12. The X-ray tube assembly as recited in claim 8 wherein the first core of said first transformer includes a first portion to which the first winding is magnetically coupled, a second portion to which the second winding is magnetically coupled, and an intermediate portion coupling the first and second portions together; distances across the first first core in one direction being smaller in the intermediate portion than in each of the first and second portions.

13. The X-ray tube assembly as recited in claim 8 further comprising a second transformer extending through an aperture in said case and attached thereto in a manner that hermetically seals the aperture, said second transformer having a magnetically conductive second core, a third winding magnetically coupled to the second core outside said case, and a fourth winding magnetically coupled to the second core inside said case and electrically connected to the filament of said vacuum tube.

14. The assembly as recited in claim 13:

wherein said vacuum tube further includes a motor having a stator and an rotor which is connected to the anode; and the assembly further comprising a third transformer extending through an aperture in said case and attached thereto in a manner that hermetically seals the aperture, said third transformer having a magnetically conductive third core, a fifth winding magnetically coupled to the third core outside said case, and a sixth winding magnetically coupled to the third core inside said case and electrically connected to the stator.

* * * * *